United States Patent [19]

Linder et al.

[11] Patent Number: 4,967,708

[45] Date of Patent: Nov. 6, 1990

[54] FUEL INJECTION VALVE

[75] Inventors: Ernst Linder, Muehlacker; Franz Rieger, Aalen; Gernot Wuerfel, Stuttgart, all of Fed. Rep. of Germany

[73] Assignee: Robert Bosch GmbH, Stuttgart, Fed. Rep. of Germany

[21] Appl. No.: 236,710

[22] Filed: Aug. 26, 1988

[30] Foreign Application Priority Data

Sep. 17, 1987 [DE] Fed. Rep. of Germany ..... 3731211

[51] Int. Cl.[5] ..... F02M 57/06

[52] U.S. Cl. ..... 123/297; 123/169 V; 313/120

[58] Field of Search ..... 123/297, 298, 169 V; 313/120

[56] References Cited

U.S. PATENT DOCUMENTS

| | | | |
|---|---|---|---|
| 642,167 | 1/1900 | Simms | 123/169 V |
| 1,310,970 | 7/1919 | Stroud | 123/169 V |
| 2,255,203 | 9/1947 | Wiegaud | 123/169 |
| 2,459,286 | 7/1949 | Rabezzana et al. | 123/169 |
| 3,173,409 | 3/1965 | Warren | 313/120 |
| 3,204,139 | 8/1965 | Candelise | 123/169 V |
| 3,502,055 | 3/1970 | Beesch | 123/297 |
| 4,093,887 | 6/1978 | Corbach et al. | 313/141 |
| 4,095,580 | 6/1978 | Murray et al. | 123/297 |
| 4,736,718 | 4/1988 | Linder | 123/297 |

FOREIGN PATENT DOCUMENTS

| | | | |
|---|---|---|---|
| 640927 | 7/1928 | France | 123/297 |

*Primary Examiner*—Andrew M. Dolinar
*Attorney, Agent, or Firm*—Edwin E. Greig

[57] ABSTRACT

In lean operation of internal combustion engines having externally supplied ignition, improvement in terms of fuel consumption and emissions are obtained if the fuel is injected directly into the combustion chamber. Because the gas exchange guide cross sections are large, the space available for installing the injection valve and spark plug is very limited, and disruptions in the course of combustion occur when the injection valve and ignition device are too far apart. By developing a fuel injection valve that has wire electrodes on the injection end to serve as an ignition device, the spark gap arcing over in the vicinity of the fuel introduced by the injection valve, optimal ignition conditions are attained even for poorly ignited fuels or when the proportion of fuel in the combustion chamber charge is extremely low (stratified charge operation).

14 Claims, 4 Drawing Sheets

FUEL INJECTION VALVE

BACKGROUND OF THE INVENTION

The invention is based on a fuel injection valve as defined hereinafter. In a known fuel injection valve of this type, the valve body protrudes beyond the encompassing holder body, from which ground electrode pins extend, approaching increasingly closer to the end of the valve body. The spark gap is formed in the radial direction in a plane shortly before the end of the valve body toward the combustion chamber. The injection opening is located not there but spaced apart from it, toward the combustion chamber, in the form of an annular gap controlled by a spherical valve closing element. This embodiment has the disadvantage that the injected fuel cannot immediately come into direct contract with the ignition spark. Moreover, the spark discharge occurs in the immediate vicinity of the valve seat, subjecting it to high thermal stress and imperiling the function of the valve.

OBJECT AND SUMMARY OF THE INVENTION

The fuel injection valve according to the invention has the advantage of enabling a uniquely has the advantage of enabling a uniquely defined, optimal association of the spark gap and the injected fuel. The best conditions for ignition, even of poorly ignitable fuels, are attained if the spark gap is located directly in the fuel injection stream, or the spark discharges via the surface of the fuel injection stream. The spark gap is located quite close to the injection opening. In this way, the fuel can be ignited reliably even if the combustion chamber is filled with a very lean mixture, especially when the engine uses a stratified charge. Moreover, the electrodes are sprayed with fuel and cooled, which lengthens their service life, prevents incandescent conditions and reduces the dissipation of heat at the valve body.

With this kind of stratified charge operation, for engines having externally supplied ignition (known as Otto engines), the goal is fuel consumption comparable to that typical of self-igniting engines operated with high air excess (that is, Diesel engines). Load regulation should be controlled via the injection quantity, similarly to how it is done in a Diesel engine, so that gas exchange losses do not occur as the throttling of the aspirated air decreases; combined with the morefavorable conversion of the stratified charge (lower heat losses at the walls), this means high efficiency, low hydrocarbon emissions and less tendency to knocking. For the sake of low fuel consumption, the fuel is injected directly into the combustion chamber with the fuel injection valve according to the invention. The inevitable moistening of the intake tube walls with fuel that occurs when injection is into the intake tube is thereby avoided, as are the attendant disadvantages in terms of fuel consumption in non-steady-state operation of the engine and during warmup. The combination fuel injection valve and ignition device overcomes the problem of having to devise an additional fuel injection location at the combustion chamber, where there is very little space available, because of the large gas exchange guide cross sections nowadays required, and because of the severely thermally and mechanically stressed webs of combustion chamber wall between the gas exchange guide cross sections, which must therefore be cooled. Moreover, the invention assures that even with small injection quantities, the fuel will be reliably engaged by the ignition spark. The aforementioned optimal ignition conditions are also attained. Such conditions prove advantageous in cold starting and engine warmup as well.

It is particularly advantageous for the electrodes located on the side of the valve body to be replaceable, because they are subjected to the greatest danger of burnoff. Thus the high-grade, expensive fuel injection valve need not itself be replaced, nor is this valve threatened with wear, as are conventional fuel injection valves of this generic type.

The invention is particularly advantageous in terms of the replaceability of the electrodes, as well as providing an embodiment that is particularly easy to manufacture and is particularly dependable in operation.

In another advantageous feature of the invention, the insulating body on the side of the combustion chamber is capable of heating up optimally, which prevents soot shunt bridges from forming; on the other hand, the fuel injection valve is far enough away from the insulating body, which is a source of heat, that it can maintain an optimal low temperature. Providing the fuel injection valve with a small diameter in the region located outside the potting in the insulating body also makes for less absorption of heat. The reduction in diameter is advantageously attained by providing the valve closing element with a wire-like shaft. Thermal dissipation and hence cooling are also attained by means of the flow of fuel through the fuel injection valve. In another feature of the invention, the insulating body heats up enough to prevent a coating of soot from forming on it. Finally, in another feature of the invention, the shielding stream is sufficiently well vented that the insulating body and cylinder head are not moistened.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
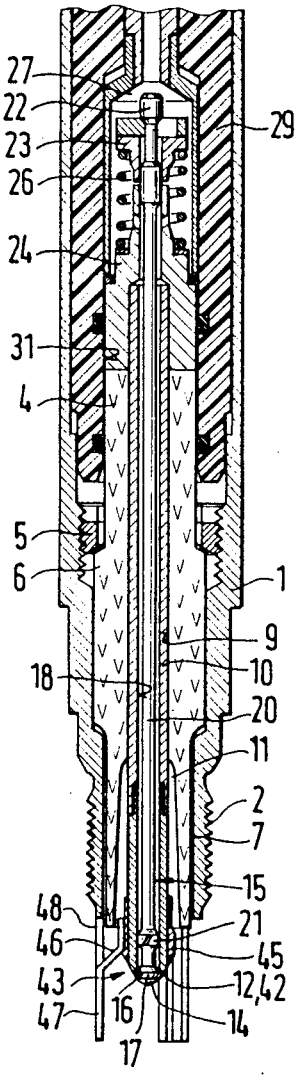
FIG. 1 shows a first exemplary embodiment of the invention.
Figure 2:
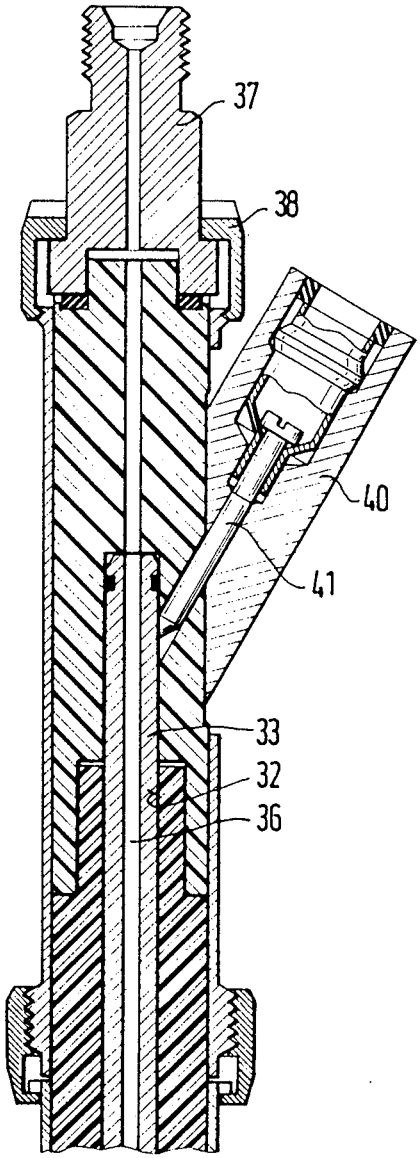
FIG. 2 shows one version of the fastening of the valve body in the fuel injection valve.

The fuel injection valve of FIG. 1 has a holder body 1, which is provided with stepped bores and has an external size M14 thread 2 on its injection end, by way of which it can be screwed into the combustion chamber wall in an internal combustion engine. The injection valve is very greatly elongated, and so only a portion of it is shown in FIG. 1. The uppermost portion of the fuel injection valve is shown in FIG. 2. An insulating body 4 is inserted into the interior of the holder body and there is axially fixed by means of tensioning nuts 5, which are pressed onto a collar. Between the collar 6 and its injection-side end, the insulating body is cylindrical, leaving a narrow annular gap 7 on the order of magnitude of 0.2 to 0.35 mm in width between it and the inner bore of the holder body 1. The end of the insulating body 4 protrudes beyond the combustion-chamber side of the holder body 1. A valve body 10 is passed through an axial bore 9 in the insulating body and supported therein. The insulating body is made of materials typically used for spark plug insulators. Toward the combustion chamber, approximately over the length of the annular gap 7, the axial bore 9 merges with a recess 11 that becomes larger nearer the combustion chamber. The valve body 10 protrudes coaxially into this recess 11. The spacing between the valve body 10 and the insulating body 4 increases continuously in this region, toward the combustion chamber. The valve body again protrudes past the end of the insulating body in the direction toward the combustion chamber and on this end has the injection opening for the injection of fuel. In the example shown, this opening is an annular gap 12, which is produced when a head 14 of a valve closing element 15 lifts from its seat face 16 in the direction toward the combustion chamber. The seat 16 is conical, narrowing toward the inside. A conical sealing face 17 is correspondingly provided on the head 14. Inside the longitudinal bore 18 of the valve body 10 adjoining the seat face 16, the head 14 located on the outside merges with an elongated, wire-like shaft 20, which between it and the wall of the longitudinal bore leaves an annular chamber and has intermittent guide faces 21. The end of the shaft 20 remote from the head 14 also has a head 22, by way of which a spring plate 23 is coupled with the shaft. A valve closing spring 26 is fastened in place between the spring plate 23 and an intermediate portion 24 adjoining the insulating body 4. The valve closing spring keeps the head 14 in the closing position as long as the fuel pressure is incapable of engaging the valve closing element 15 sufficiently to move it into the opening position. The intermediate portion 24 comprises electrically conductive material and is joined to the end of the valve body 10, for instance by soldering. Adjacent to the intermediate element in the interior of the fuel injection valve, a spring chamber 27 is formed, into which the end of the shaft 20 protrudes and in which the valve closing spring is also disposed. This spring chamber is disposed in an optionally multi-part cylindrical body 29 of electrically nonconductive material. The body 29 has a stepped bore, and both the cylindrical end of the insulating body and the intermediate portion 24 are inserted tightly into the portion 31 of the stepped bore that has the larger diameter. An electrically conductive insert 33, having a cup-shaped portion which protrudes into the stepped bore portion 31 having the larger diameter, is guided through the smaller portion 32 of the stepped bore adjoining the larger portion 31. The insert 33, forming the spring chamber 27, encompasses the end of the shaft 20 along with the spring plate 23 and the valve closing spring 26 and rests positively on the face end of the intermediate portion 24, holding it on the insulating body 4. In the portion 32 of the stepped bore having the smaller diameter, the insert is tubular, having a fuel conduit 36 by way of which fuel reaches the spring chamber 27 and is carried from there into the annular chamber between the shaft 20 and the valve body. On its end, the insert rests on the face end of the stepped bore portion having the smaller diameter, and from there the fuel line 36 leads away to the outside, via a connection nipple 37. This connection nipple 37 also serves as a pressure pad, which is screwed to the holder body 1 by means of a union nut 38 and, with the cylindrical body 29 interposed, braces the insert 33 and the intermediate portion along with the collar 6 against the insulating body 4 in the holder body 1.

As FIG. 2 shows, a union piece 40 of insulating material is disposed on the side of the holder body 1. An electrical contact-making screw 41 is screwed in through the union piece 40, and arranged to rest with its end on the electrically conductive insert 33. The electrical contact-making screw 41 serves to deliver a high voltage.

Figure 3:
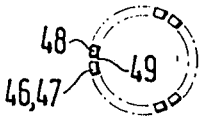
FIG. 3 shows the disposition of the electrodes with respect to the injection location.

As noted above, the combustion-chamber end of the valve body protrudes past the end of the insulating body 4. The fuel injection location 42 is located on the outermost end, and as described, this location comprises the controllable annular gap 12. A sheath 45 is also disposed on this combustion-chamber end 43 of the valve body, adjoining the fuel injection location 42 toward the insulating body 4. This sheath may be joined either detachably or non-detachably to the valve body. Detachable connections will be described in further detail below. Secured to the sheath is a wire-like electrode 46, which after a bend extends axially parallel to the axis of the valve body 10, protruding past it toward the combustion chamber. The axially parallel end portion 47 is located on a circle that is concentric with the axis of the valve body 10 and the diameter of which corresponds to that of the face end of the holder body 1. A wire-like electrode 48 extends away from this point likewise parallel to the axis of the valve body, and terminates in the circumferential direction of the aforementioned circle next to the axially parallel end 47 of the wire-like electrode 46. As the sectional view of FIG. 3 shows, three pairs of wire-like electrodes 47, 48 are distributed spaced apart from one another on the circumference of this circle. One spark gap 49 is located between each of these electrodes in the circumferential direction of this circle. The wire-like electrode 46 is disposed with its axially parallel end portion 47 such that this end portion is located in the vicinity of the fuel stream emerging at the injection location. Because of the configuration of the head 14, the fuel stream is in the form of a so-called shield stream or fan stream, which widens or diverges as it moves into the combustion chamber. The wire-like electrodes 46 and 48 are parts of a spark ignition device with the aid of which a spark is generated upon fuel injection, which discharges via the surface of the fuel stream. This leads to the advantages described at the outset above. The radial spacing of the electrodes from the injection location 42 should also be optimized. The voltage supply to the spark ignition device is effected via the ground contact, by means of the holding body screwed into the cylinder head of the engine, on the one hand, and via the contactmaking screw 41, on the other. From this screw, the electrical voltage is carried via the insert 33, the intermediate portion 24, the valve body 10 soldered into the intermediate portion, and via the sheath 45 to the electrode 46, from where the spark discharge to the ground electrode can take place. To make the electrodes last longer, they are either coated with platinum, or else parts of the electrodes are manufactured directly from platinum or from some other burnoff-proof, electrically conductive material.

With such a combination fuel injection valve and ignition device, the above-mentioned advantages are attainable. The valve body 10 is embodied as very slender, and it correspondingly has a small heat-absorbing surface area. This is attainable because the valve closing element is provided with a very thin shaft 20, which may itself also have resilient properties, as is known from various injection valves. In addition, however, the closing spring 26 is provided, which advantageously prevents excessive stretching or failure of the shaft 20 when load changes are overly frequent. A relatively long distance is provided between the site where the valve body emerges from the axial bore 10 in the insulating body, and the end of the insulating body, so that here a greater surface area of the insulating body is exposed to the hot combustion gases, enabling it to heat up markedly, in order to prevent deposits from forming shunting routes. At the same time, however, a sufficient distance from the valve body 10 is maintained, so that only a limited amount of heat, in the form of radiant heat, is absorbed from the insulating body by the valve body. The valve body is also cooled by the supplied fuel, which emerges at the injection location 42. With the wire-like electrodes, the heat source represented by the spark discharge is also shifted away from the valve body, advantageously into a vicinity that is regularly supplied with fuel for injection. This guarantees reliable ignition of the injected fuel, even if unfavorable fuel-air mixtures or unfavorable ignition conditions otherwise prevail in the combustion chamber.

Figure 4:
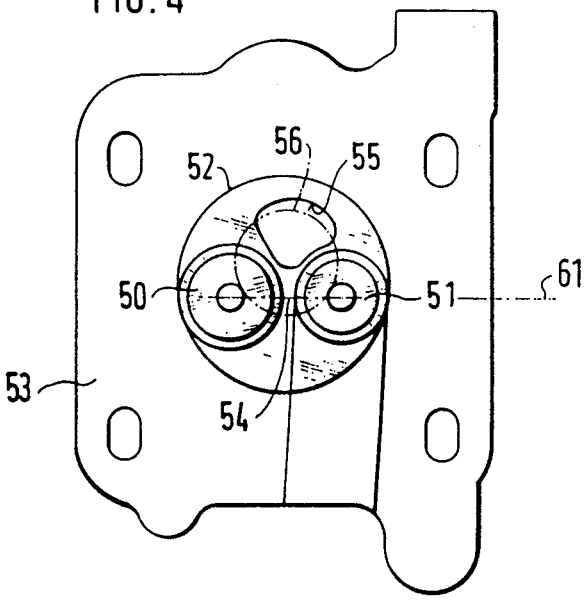
FIG. 4 shows the site where the fuel injection valve according to the invention is mounted in the cylinder head of an internal combustion engine.

The fuel injection valve described is embodied as highly elongated and very slender, so that even with unfavorable conditions for its installation, such as may be the case in 4-valve engines, it can be secured in the engine at the optimum site on the combustion chamber wall. FIG. 4 shows a plan view on a 2-valve cylinder head, with a gas exchange inlet valve 50 and a gas exchange outlet valve 51. These valves are located inside the projection 52 of the engine cylinder diameter on the cylinder head 52. Optimally, fuel should be delivered and ignited as nearly as possible in the center of the combustion chamber. In this region, however, there is typically only a very narrow web 54 of the cylinder head wall between the gas exchange inlet valve and the gas exchange outlet valve. This web is subject to severe thermal and mechanical stresses and moreover, at least for thermal reasons, it must be optimally cooled. This does not allow any passage through it for devices such as a spark plug or injection valve. The only site where these devices can be accommodated is accordingly the circle sector 55 (which may also be disposed laterally reversed from the arrangement shown for the sector of in FIG. 4). The circle drawn in dashed lines indicates a piston recess 59, which should be associated with the circle sector 55 or with the injection location and the ignition location. Until now, the injection valve and the spark plug were disposed separately, mirror-inverted from one another, above and below the line 61 connecting the gas exchange cross sections. This lead to unfavorable ignition conditions, which had a particularly adverse effect during idling at low load. With the fuel injection valve according to the invention, a compact accommodation of the injection valve and ignition device in the vicinity of the circle sector 55 is possible, and thus optimal operating conditions, in particular for an engine driven with a lean fuel mixture, can be attained. The aforementioned poor cold-starting conditions associated with the separate disposition of the ignition device and spark plug are now improved, as are the idling properties. Moreover, excessive uncombusted hydrocarbons are avoided, and the tendency to knocking is lessened. In particular, however, qualitative regulation in all operating ranges without disruption is possible; with this condition having been achieved means that the aspirated air quantity need not be throttled for load control.

Figure 5:
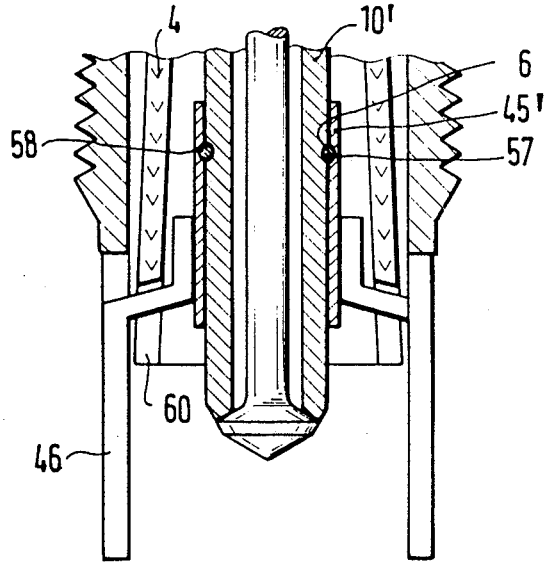
FIG. 5 shows a second exemplary embodiment of the invention, in which the electrode associated with the valve body of the fuel injection valve is seated on a sheath that is replaceably interlocked with the valve body.

FIG. 5 shows part of a fuel injection valve, which is basically similar to that of FIGS. 1–3. Elements shared with that valve are therefore not described again here. Deviating from the first embodiment, the sheath 45' is now embodied as a part that can be slipped onto the end of the valve body 10'; the wire-like electrodes 46, here totalling four in number, are secured to the sheath in the same manner as above. For positionally fixing the sheath 45', in the present case a recess 66 is provided in the valve body 10' and this recess is engaged by a resilient ring 57, which at the same time engages a recess 58 on the sheath. The recess on the valve body 10' is advantageously an annular groove. A modified fastening may instead be provided by dividing the end of the sheath into resilient tongues having inwardly oriented protuberances that lock in detent fashion in corresponding recesses of the valve body. That has the advantage of assuring not only an axial but also a rotational fastening. A rotational fastening is also attainable by providing the end of the insulating body 4 with slits 60, through which the bend of the electrode 46 is guided. In such embodiments, the electrode 46 can be replaced, if too much of it burns off, without having to perform major repair of the fuel injection valve, or even having to throw it away.

Figure 6:
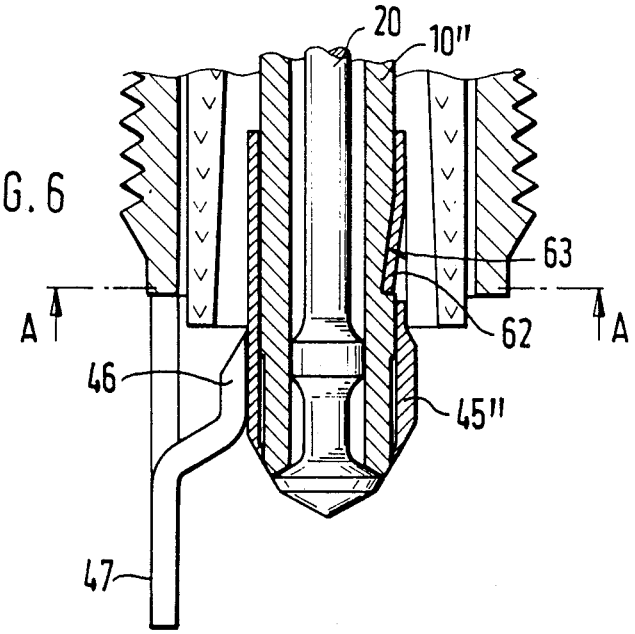
FIG. 6 shows a third exemplary embodiment with a modified fastening of the sheath of FIG. 5.

Another embodiment of a replaceable electrode is shown in FIG. 6. In this concept, the sheath known from FIG. 1, here in the form of a sheath 45'', is slipped onto the end of the valve body 10''. The sheath itself is embodied identically, with respect to the electrode 46, to the sheath of FIG. 1; the only difference is that the sheath here has a stamped-out spring tongue 62, which is bent inward and can lock in detent fashion into a corresponding recess 63, adapted to the position of repose of the spring tongue, on the jacket face of the valve body 10''. With this spring tongue and the adapted recess, it is possible both to secure the sheath 45'' positionally correctly in the axial direction and to maintain a desired rotational position.

Figure 7:
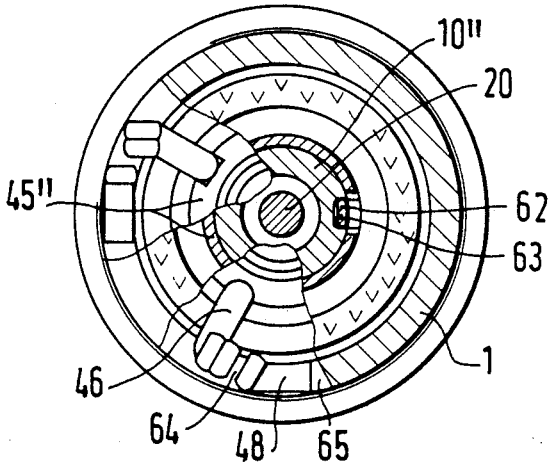
FIG. 7 is a section taken through the exemplary embodiment of FIG. 6.

FIG. 7 is a section taken along the line AA of FIG. 6 showing partial plan views, from which the location of the wire-like electrodes 46 and 48 can be seen. From this figure, the location of the spark gap 64 between the wire-like electrodes is clearly apparent. One wire-like electrode 46 is inserted into a recess on the sheath, where it is fixed by welding, and the other wire-like electrode 48 is bent and welded onto the face end 65 of the holder body 1.

Figure 8:
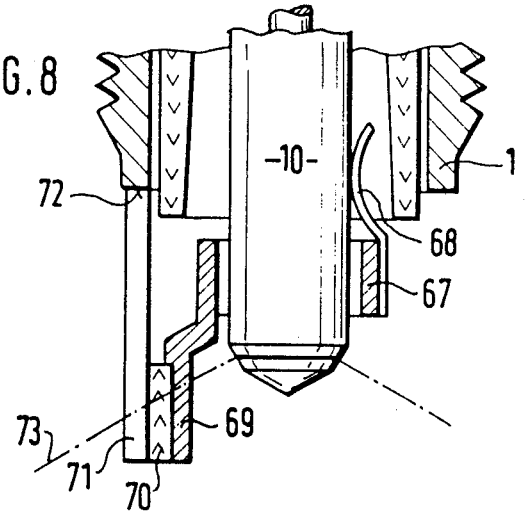
FIG. 8 shows a fourth exemplary embodiment of the invention having a third embodiment of a replaceable electrode on the valve body.

In an alternative embodiment, shown in FIG. 8, a sheath 67 is slipped onto the end of the valve body 10 and is in secure contact with the valve body 10 by means of contact clamps 68. Extending away from the sheath, once again, is a wire-like electrode 69, which after being bent extends parallel to the axis of the valve body 10 and is connected, via a radially attached insulating element 70, to a wire-like electrode 71. This electrode 71 again extends parallel to the axis of the valve body 10 and terminates at the face end 72 of the holder body 1 oriented toward the combustion chamber. The wire-like electrode 71 contacts ground at that point. In this embodiment, a surface-discharge spark gap forms between the electrodes 71 and 69, located in the direction of the shield-shaped fuel stream represented by dot-dashed lines 73. Instead of a shield-shaped stream, individual streams or jets can naturally be produced, using an orifice nozzle. The fastening of the sheath can be done analogously to what is shown in FIGS. 1–7, or else by welding the wire-like electrode 71 to the face end 72. In that case, the sheath 67 can be located radially spaced apart about the valve body 10, and the electrical contact can be made merely with the contact clamp 68. In this version, the thermal load on the valve body 10 is still further reduced as compared with the foregoing embodiments.

Figure 9:
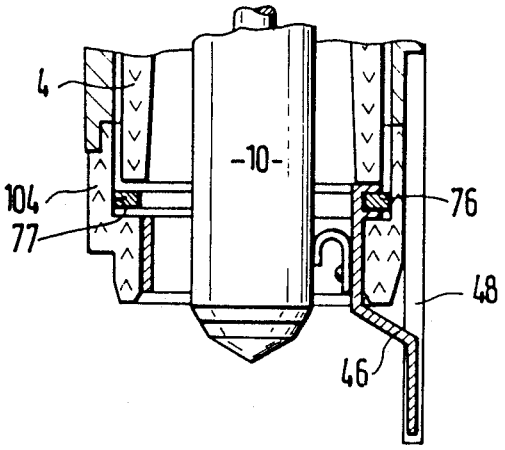
FIG. 9 shows a fifth exemplary embodiment of the invention having another version of a replaceable electrode, which this time is retained on the insulating body.
Figure 10:
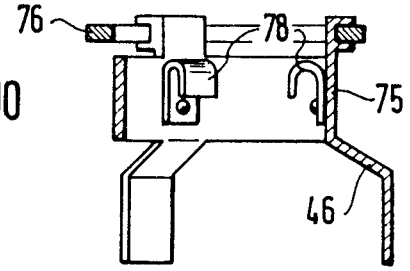
FIG. 10 is a detailed view of the electrode shown in FIG. 9.

A final embodiment of the fastening of the wire-like electrodes is shown in FIGS. 9 and 10. This exemplary embodiment once again has one or more electrodes 46 that can be replaced together. These electrodes, as in the foregoing embodiments, are bent and are fastened to a ring element 75. This element has a circumferentially resilient ring 76 on its outer circumference, with which the ring element 76 can be snapped into an annular groove 77 on the inside of the insulating body 4. Resilient contact elements 78 protrude from the inside of the ring element and, in the installed position of the ring element, come into electrically conductive contact with the valve body 10. Otherwise, the electrodes 46 and wire-like electrodes 48 are arranged in the same way as those shown in FIGS. 1–7. To improve the fastening conditions, the annular groove 77 can be provided not on the end of the insulating body 4 but on a separate insulating body 104 connected to the end face of the holder body 1. Toward the combustion chamber, this insulating body 104 protrudes past the end of the insulating body 4, which is embodied like that of FIGS. 1–8. The annular groove 77 may also be formed by providing the insulating body 104 with a stepped wall or zone, between the combustion-chamber end of the insulating body 4 and a shoulder of the insulating body 104.

This embodiment again enables the attainment of the aforementioned advantages of a fuel injection valve combined with an injection device. Similarly to FIG. 8, the valve body is thermally stressed to an even lesser extent, because the flow of heat from the electrode 46 is reduced by the special fastening and electrical connection provided.

The foregoing relates to preferred exemplary embodiments of the invention, it being understood that other variants and embodiments thereof are possible within the spirit and scope of the invention, the latter being defined by the appended claims.

What is claimed is:

1. A fuel injection valve having a tubular valve body (10), on one end of which a fuel outlet having at least one controlled injection opening (12) is provided, an electrically insulating body (4) in which the valve body (10) is retained, said insulating body being confined in a holder body (1) comprising electrically conductive material, further wherein the holder body of the fuel injection valve can be connected to an internal combustion engine and the end of the valve body (10) which protrudes from the insulating body, has at least one wire-like electrode (46) which is in electrically conductive contact with the valve body (10) and which forms together with a second wire-like electrode (48) affixed to the holder body (1) a spark gap (49) of a spark ignition device, wherein the electrical voltage is delivered via the holder body (1) on the one hand and the valve body (10) on the other, both wire-like electrodes are space wire-like electrode (48) of the holder body (1) is located in a circumferential direction of a circle about the axis of the valve body (10), beside the wire-like electrode (46, 47) of the valve body (10) and thereby forms said spark gap (49), in the injection region of the fuel which emerges transversely to the longitudinal axis of the valve body injection opening (12).

2. A fuel injection valve as defined by claim 1, in which the wire-like electrode (46) of the valve body is affixed to a replacement ring element (45′, 45″, 67, 75), which is associated with the valve body (10) or the insulating body (4, 104).

3. A fuel injection valve as defined by claim 2, in which the ring element comprises a sheath (45′) which emcompasses the valve body (10′) and is held thereon by a detent means.

4. A fuel injection valve as defined by claim 2, in which the ring element comprises a sheath having at least one resilient end portion, at least one end of said at least one resilient end portion being provided with at least one inwardly protruding detent element which is capable of snapping into a corresponding recess on the valve body.

5. A fuel injection valve as defined by claim 2, in which the ring element comprises a sheath (45″), having at least one punched-in spring tongue (62) arranged to be received in a recess (63) on the valve body (10″).

6. A fuel injection valve as defined by claim 5, in which the free end of the spring tongue (62) is directed downwardly toward the injection opening (42) and the recess (63) is adapted to properly index the spring tongue, to thereby secure the sheath both axially and radially.

7. A fuel injection valve as defined by claim 3, in which the insulating body (4, 104) includes an annular groove(77) and the ring element is connected on its outer circumference with a resilient ring (76), which is capable of snapping into said annular groove.

8. A fuel injection valve as defined by claim 1, in which the insulating body (4) and the holder body each have a predetermined length, the length of said insulating body extending beyond one end of said holder body.

9. A fuel injection valve as defined by claim 8, in which the length of said insulating body (4) terminates at a distance which is above said injection opening.

10. A fuel injection valve as defined by claim 8, in which the injection opening (12) is positioned at a distance at least 3 mm removed from the insulating body and thereby extends farther into the combustion chamber.

11. A fuel injection valve as defined by claim 1, in which at least a portion of the wire-like electrodes (46, 47, 48) comprise platinum.

12. A fuel injection valve as defined by claim 1, in which at least a portion of the wire-like electrodes (46, 47, 48) comprises a platinum coating.

13. A fuel injection valve as defined by claim 1, in which the fuel injection valve has an outwardly opening valve closing element which is provided with sealing face (17) embodied as narrowing conically toward the inside, said sealing face of said valve closing element adapted to rest on a corresponding sealing face (16) on the valve body under the influence of the closing force of a resilient element associated with the fuel injection valve.

14. A fuel injection valve as defined by claim 13, in which the valve closing element comprises a head (14), said head (14) provided with the conical sealing face (17), and being located on the combustion chamber side toward the valve seat (16), and an elongated, wire-like shaft (20), adapted to support said head (14) in the fuel injection valve.

* * * * *